US011408231B2

(12) United States Patent
Moore et al.

(10) Patent No.: US 11,408,231 B2
(45) Date of Patent: Aug. 9, 2022

(54) ROLLER REAMER

(71) Applicant: Hole Opener Corporation International, Lafayette, LA (US)

(72) Inventors: Jonathan Adam Moore, Youngsville, LA (US); Paden Joseph Alleman, Broussard, LA (US)

(73) Assignee: HOLE OPENER CORPORATION, INTERNATIONAL, Lafayette, LA (US)

( * ) Notice: Subject to any disclaimer, the term of this patent is extended or adjusted under 35 U.S.C. 154(b) by 0 days.

(21) Appl. No.: 16/311,081

(22) PCT Filed: Jun. 22, 2017

(86) PCT No.: PCT/US2017/038645
§ 371 (c)(1),
(2) Date: Dec. 18, 2018

(87) PCT Pub. No.: WO2017/223259
PCT Pub. Date: Dec. 28, 2017

(65) Prior Publication Data

US 2020/0165877 A1 May 28, 2020

Related U.S. Application Data

(60) Provisional application No. 62/353,132, filed on Jun. 22, 2016.

(51) Int. Cl.

| | |
|---|---|
| ***E21B 10/30*** | (2006.01) |
| ***E21B 10/10*** | (2006.01) |
| ***E21B 10/22*** | (2006.01) |
| ***E21B 23/00*** | (2006.01) |

(52) U.S. Cl.
CPC ..... *E21B 10/30* (2013.01); *E21B 10/10* (2013.01); *E21B 10/22* (2013.01); *E21B 23/00* (2013.01)

(58) Field of Classification Search
CPC ..... E21B 10/30; E21B 10/10; E21B 10/22; E21B 23/00
See application file for complete search history.

(56) References Cited

U.S. PATENT DOCUMENTS

| | | | | |
|---|---|---|---|---|
| 3,907,048 A * | 9/1975 | Gray | E21B 10/30 | 175/325.3 |
| 4,261,426 A * | 4/1981 | Garrett | E21B 10/30 | 175/228 |
| 5,381,868 A * | 1/1995 | Schock | E21B 10/10 | 175/325.3 |
| 2011/0203849 A1* | 8/2011 | Radford | E21B 10/322 | 175/57 |

* cited by examiner

*Primary Examiner* — Dany E Akakpo
(74) *Attorney, Agent, or Firm* — Law Office of Jesse D. Lambert, LLC

(57) ABSTRACT

A roller reamer for downhole operations in boreholes, such as are drilled for oil and/or natural gas production, or as injection wells. An elongated main body has preferably three circumferentially spaced pockets. A roller assembly is preferably disposed in each pockets, the roller rotating in roller blocks at each end of the roller disposed within the roller blocks. Mating locking profiles, such as dovetails, lock the roller blocks within the pockets, as the roller blocks are moved longitudinally into the locking profiles, preventing any radially outward movement of the roller assembly. The roller assembly is prevented from longitudinal movement within the pockets by lock blocks also positioned within the pockets.

5 Claims, 13 Drawing Sheets

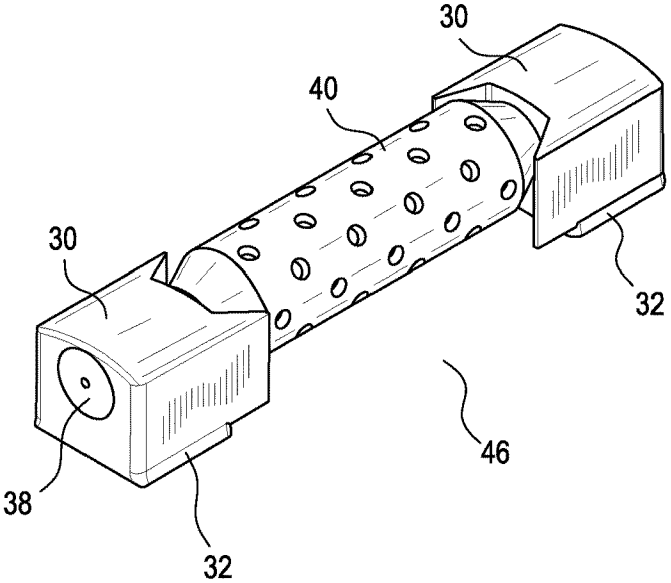
FIG. 5
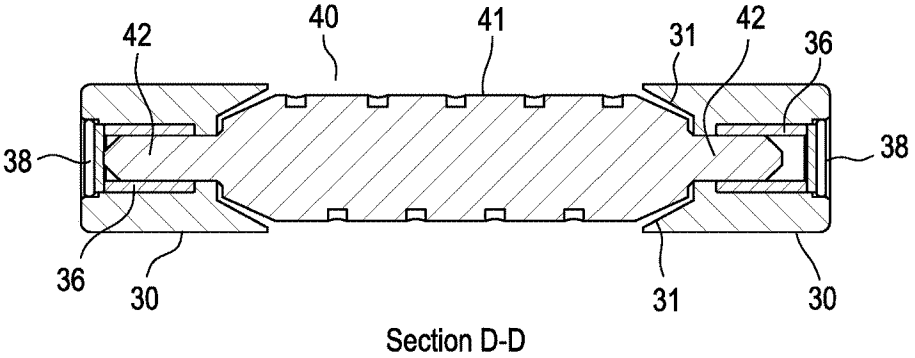
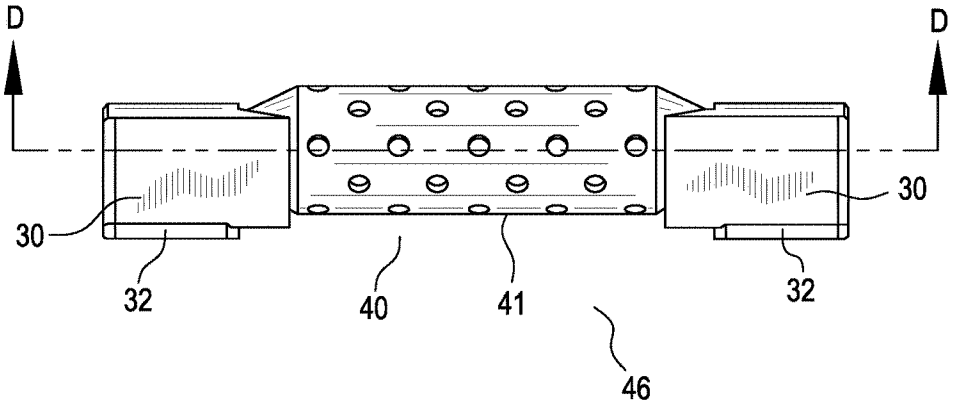

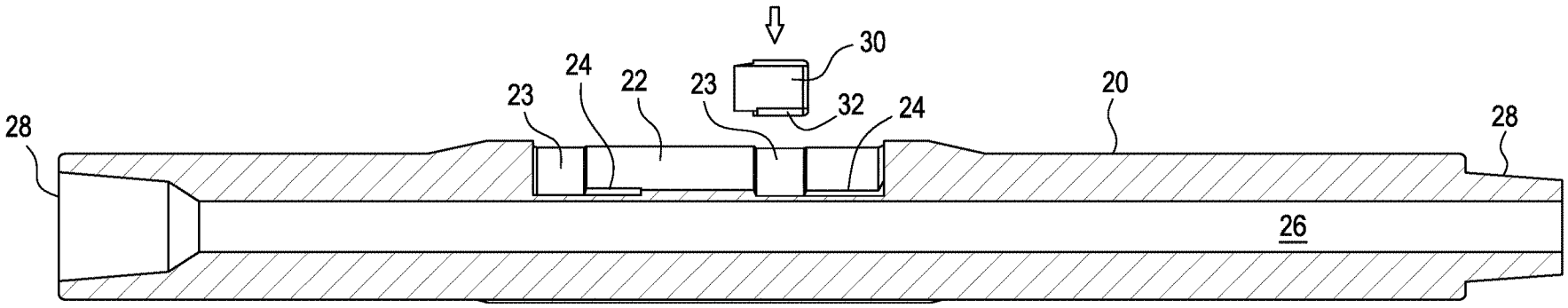
FIG. 9
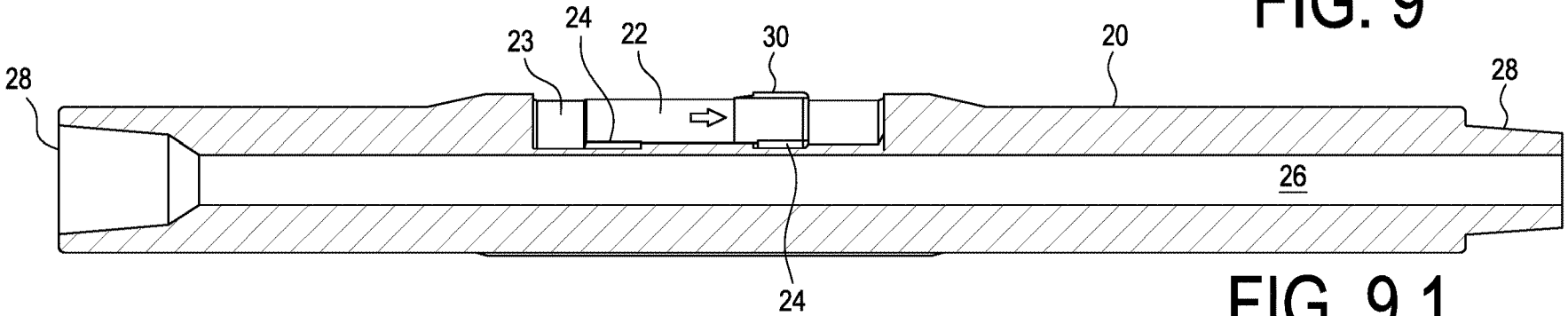
FIG. 9.1
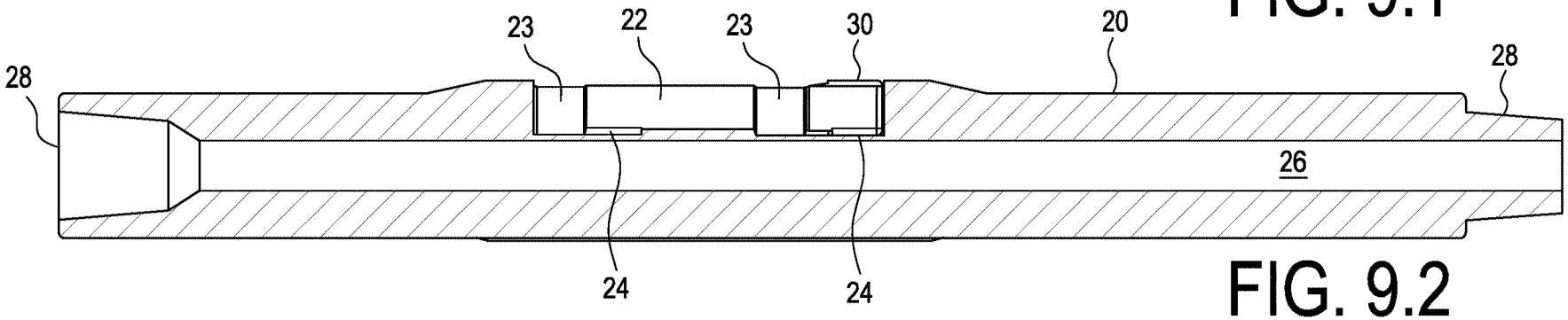
FIG. 9.2

ROLLER REAMER

CROSS REFERENCE TO RELATED APPLICATIONS

This non-provisional U.S. Patent application claims priority to U.S. provisional patent application Ser. No. 62/353,132, filed Jun. 22, 2016, for all purposes. The disclosure of that provisional patent application is incorporated herein, to the extent not inconsistent with this application.

BACKGROUND—FIELD OF THE INVENTION

This invention relates to tools typically used in connection with downhole operations in boreholes drilled into the earth, for example oil and gas wells, and other types of wells such as injection wells and the like. In particular, this invention relates to tools commonly referred to as "roller reamers," which generally comprise tools having an elongated main body with one or more longitudinally-placed roller elements fixed to the main body outer diameter. Various types of roller elements may be used depending upon the nature of the task being addressed.

SUMMARY OF THE INVENTION

The roller reamer embodying the principles of the present invention comprises an elongated main body having one or more roller pockets arranged around its outer circumference. A downhole tool element, which may be rollers in a roller assembly, is mounted in the pockets. The rollers are generally aligned with the longitudinal axis of the main body, and have extended pins protruding from either end which are disposed in a bearing, for example a self-lubricating bearing, with the bearing in turn disposed in a roller block. Preferably, the pins are integral with the body of the roller; alternatively, the pins may be the protruding ends of a central elongated rod or pin extending through a longitudinal hole or bore in the body of the roller. When the roller reamer is assembled, the roller blocks are fixed in the main body pockets, and the roller element pins are disposed in the bearings. The pockets have locking profiles sized and shaped to receive a roller block moved longitudinally into the locking profile. The locking profile in the pocket may be a dovetail, with the bottom portion of the roller blocks also having a dovetail shape, e.g. a male dovetail, to engage mating female dovetails in the bottom of the main body pockets. To assemble the tool, a first (typically the downhole) roller block is inserted into place in the corresponding dovetail. A second, typically the upper or uphole, roller block is fitted over the upper pin on the roller. The roller and upper roller block can be inserted as an assembly (a roller assembly) into the pocket, with the lower roller pin aligned with the bearing in the lower roller block, then the assembly is moved axially into place, stabbing the roller pin into the lower roller block bearing and sliding the upper roller block into the corresponding dovetail. Once the upper or second roller block is slid axially into place, the roller blocks, and therefore the roller, are radially locked into the pockets with no radial movement (i.e., radially outward from the pockets) possible. The roller reamer comprises a means for preventing longitudinal movement of the roller assembly, for example lock blocks inserted into the space created within each of the pockets when the second roller block is slid axially (typically in a downhole direction) into place into the dovetail, namely the space between the uppermost lock block and the uppermost edge of the pocket. Lock block pins (retaining pins) are inserted (typically at an angle to the longitudinal axis of the main body) through the lock blocks, and threadably fastened into the main body, fixing the lock blocks to the main body. With the lock block pins in place, the lock blocks are fixed to the main body within the pockets; the lock blocks prevent any axial or longitudinal movement of the roller blocks/rollers within the pockets, keeping the roller blocks locked in the dovetails. It is readily understood that the roller blocks and the rollers disposed therein remain locked into place via the dovetails.

BRIEF DESCRIPTION OF THE DRAWINGS

FIG. 5 shows perspective, side, and section views of a roller disposed in the roller blocks.

FIGS. 9, 9.1 and 9.2 show a sequence of inserting a first, typically lower or downhole, roller block into place in a pocket of the main body and engaging the dovetail.

DESCRIPTION OF THE PRESENTLY PREFERRED EMBODIMENT(S)

While various roller reamers can embody the principles of the present invention, with reference to the drawings some of the presently preferred embodiments can be described. In a broad sense, the apparatus described herein is a downhole tool element carrier, which in one embodiment is a roller reamer 10, as described below. In other embodiments, other downhole tool elements may be used in lieu of rollers, as described below.

Figure 1:
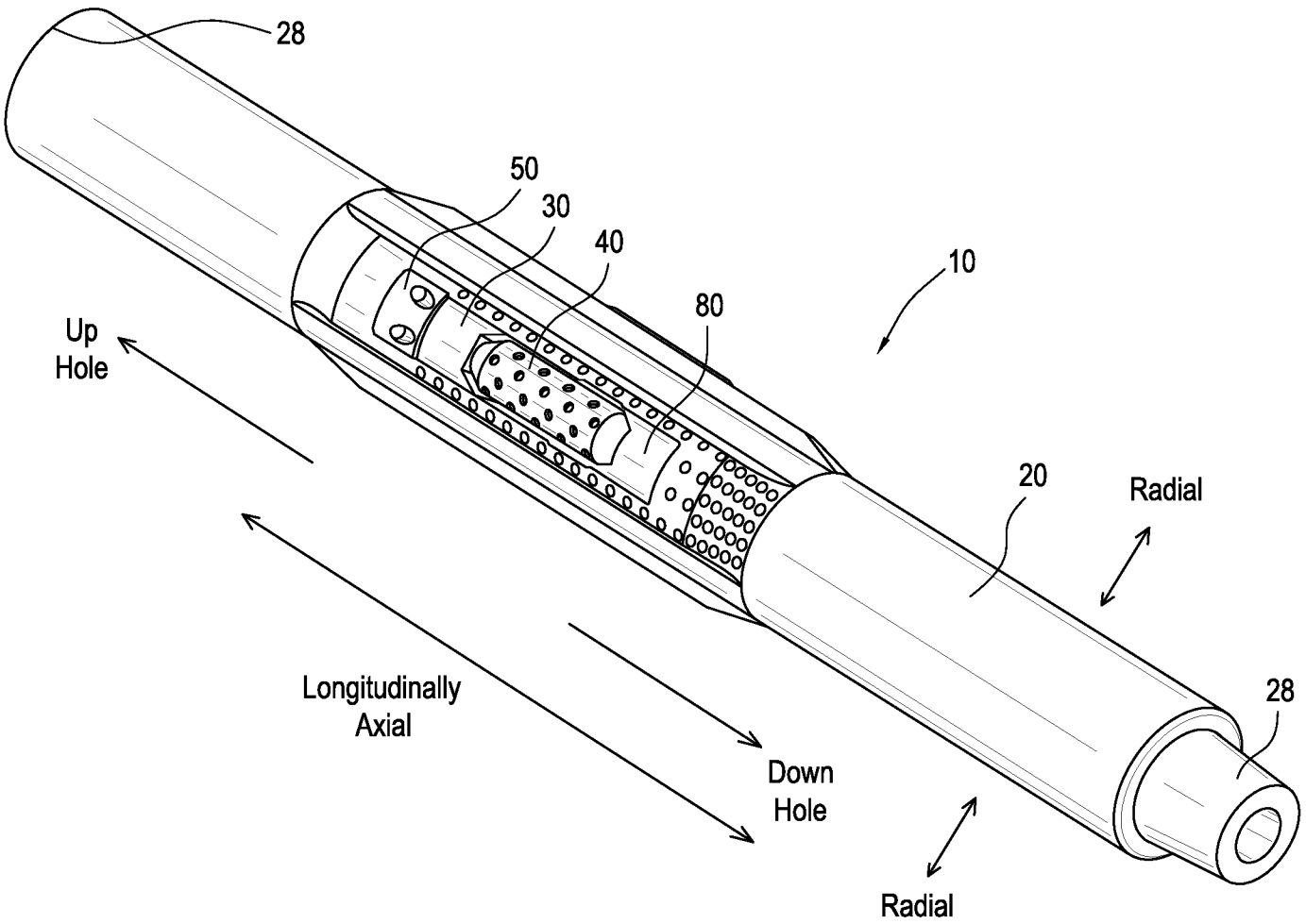
FIG. 1 is a perspective view of the assembled roller reamer.
Figure 2:
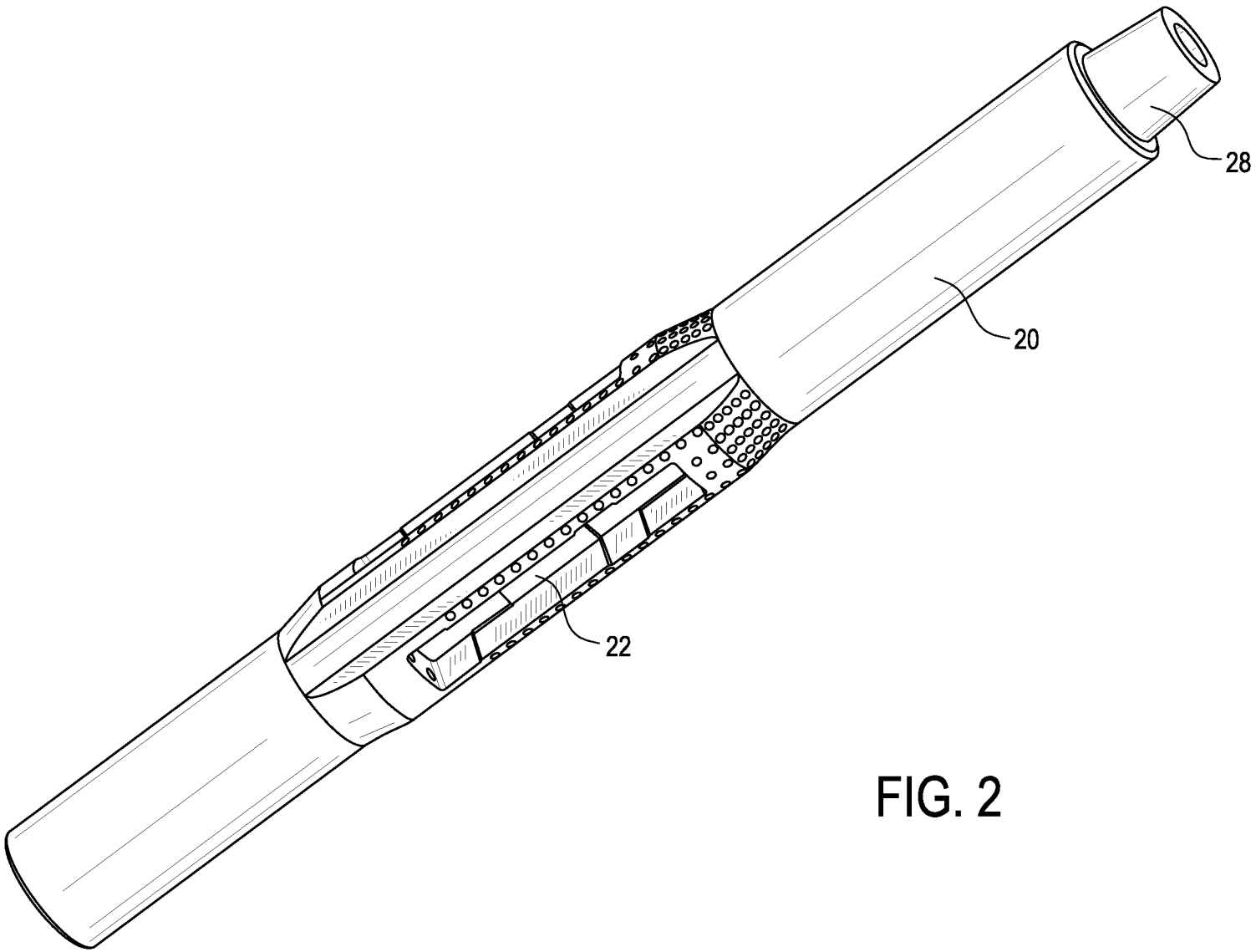
FIG. 2 is a perspective view of the main body of the roller reamer, without the rollers, roller blocks, etc. in place.

FIG. 1 is a perspective view of the roller reamer, showing the rollers and other elements in place. Referring to FIGS. 1-5, roller reamer 10 comprises an elongated main body 20, typically having a longitudinal bore 26 therethrough and threaded connections 28 at either end, for connection into a tubular string (typically, a drillstring composed of drill pipe).

Figure 3:
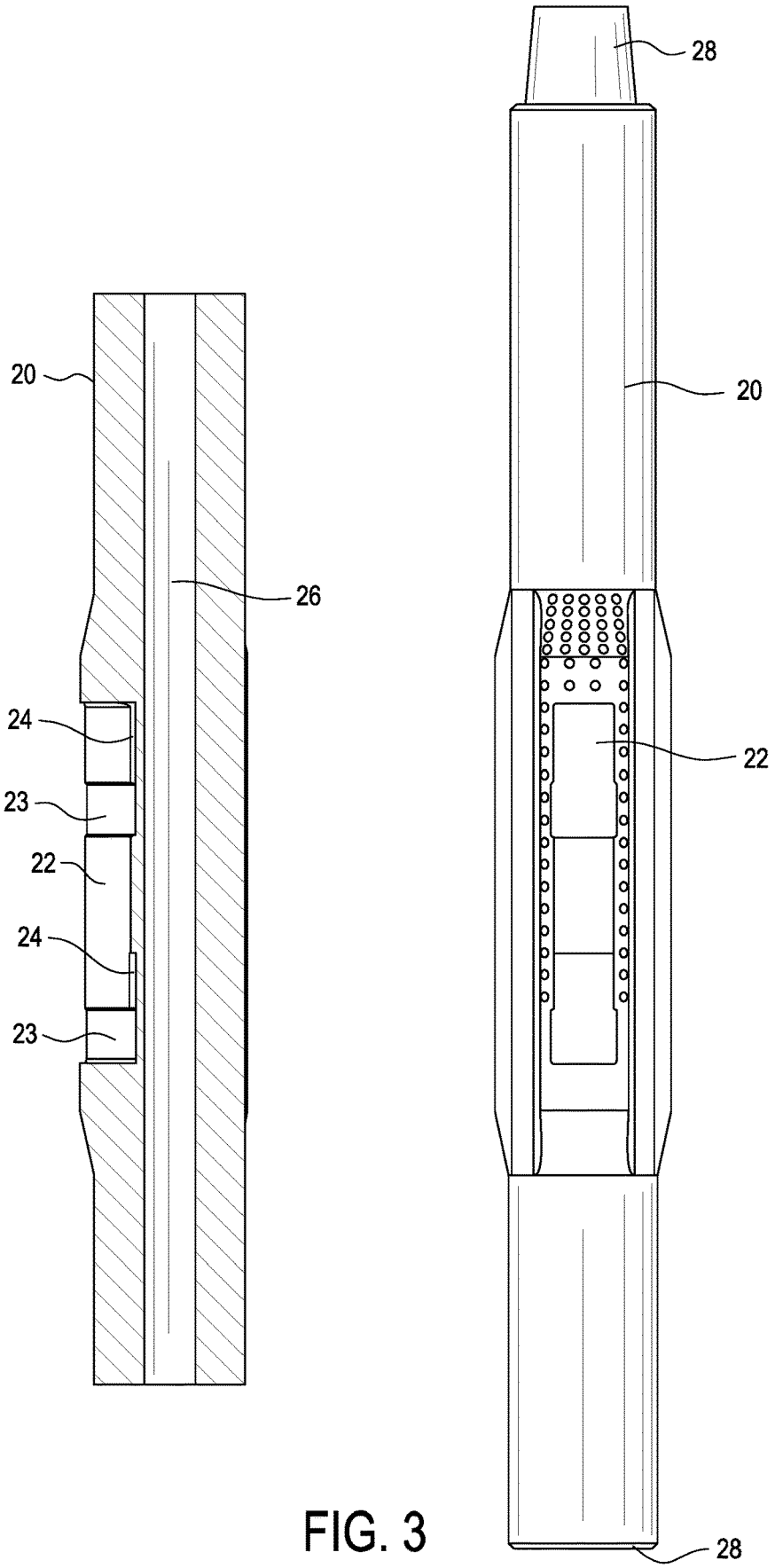
FIG. 3 is a side view, including side section view, of the main body of the roller reamer, without the rollers/roller blocks, etc. in place.
Figure 4:
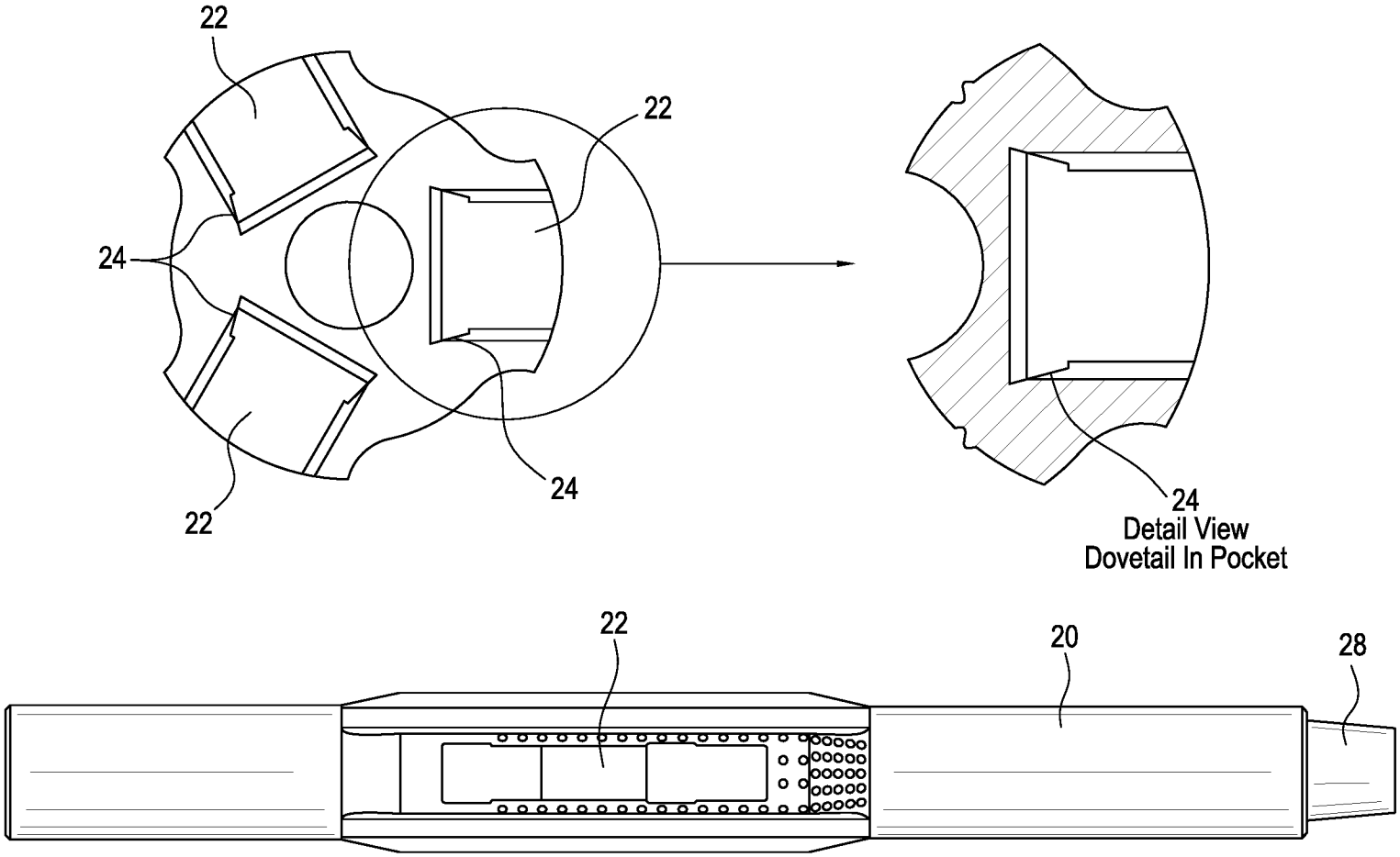
FIG. 4 is a side view and a section view down the longitude of the tool, of the main body of the roller reamer, without the rollers/roller blocks in place. In addition, a detailed view of a roller block pocket is shown, showing the dovetail at the base of the pocket.

As is known in the art, roller reamer 10 is made up into a drillstring and lowered to a desired location in a borehole, where operations are conducted. Main body 20 further comprises one or more, typically a plurality, for example three, of longitudinally elongated roller assembly pockets 22 spaced about the circumference of the main body. As discussed further below, and as can be seen in FIGS. 3 and 4, at least one of roller assembly pockets 22 have locking profiles sized and shaped to receive a roller block, which are at least one, preferably two dovetails 24, typically (but not exclusively) female dovetails, spaced apart from one another in the base of the pockets. As is later described, the roller assembly pockets further have recesses 23 which permit the roller blocks to be inserted into position then slid into place in dovetails 24.

Note that the typical directional orientation of the roller reamer is shown by the notations (and the text herein) of "up," "upper," "uphole," "down," "lower," and "downhole," as shown in FIG. 1, and as will be understood by those skilled in the relevant art. "Longitudinal" and "radial" directions are also shown in FIG. 1. The same directional indicators apply to the other figures, as well. Note further that same are done for illustrative purposes only. The orientation and placement of many of the elements could be reversed if desired.

Roller reamer 10 preferably comprises a plurality of downhole tool elements, which may comprise roller assemblies 46, one positioned in each of the roller assembly pockets 22. FIG. 5 shows perspective, side, and section views of a roller assembly 46. Roller assemblies 46 comprise an elongated roller 40 having a central section 41 and pins 42 extending from either end. Preferably, pins 42 are integral with central section 41 of roller 40; that is, pins 42 and central section 41 are milled or machined from a single piece of material. Alternatively, pins 42 may be the protruding ends of a central pin or rod extending longitudinally through a longitudinal bore through roller 40, with appropriate journal or similar bearings, seals, lubrication, etc. as required.

As can be seen in the drawings, roller 40 may have hardened inserts, e.g. carbide or PDC inserts, in its outer surface. Pins 42 are disposed in bearings 36, which in turn are disposed in bearing holes 34 in roller blocks 30. Preferably, bearings 36 are what are know as "oil less" bearings in the relevant art. Alternatively, other bearings requiring seals and lubrication could be used. Roller 40 is therefore free to rotate relative to roller blocks 30. Plugs 38 seal the ends of bearing holes 34, with additional seals (O-rings or otherwise) as appropriate. Roller blocks 30 have dovetails 32 on their lower surfaces. Although FIG. 5 shows male dovetails on roller blocks 30, it is understood that female dovetails could also be used, engaging male dovetails in roller pockets 22. A contour 31 may be provided in roller blocks 30 to accommodate the ends of the central section 41 of roller 40. As is later described, in a presently preferred embodiment, rollers 40 are attached to main body 20 by placement of roller blocks 30 in a sequential fashion.

Figure 6:
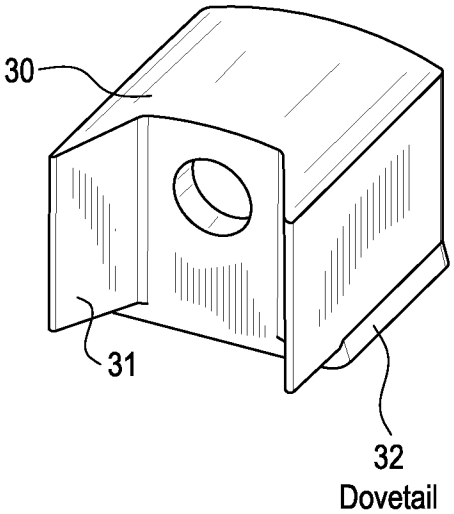
FIG. 6 shows perspective, end and section views of roller blocks.
Figure 6:
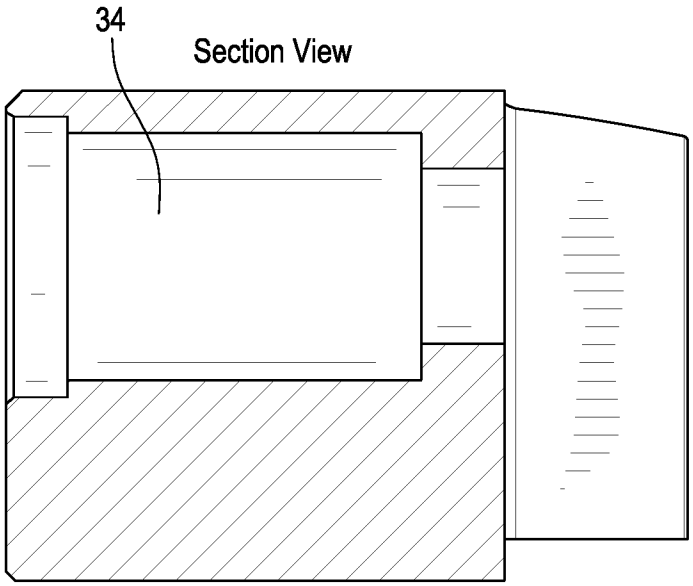
Figure 6:
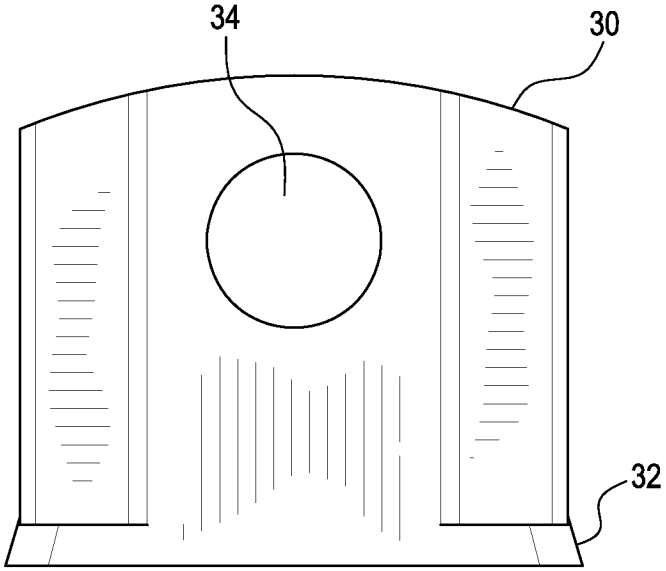

FIG. 6 comprises side, end, and perspective views of a roller block 30. Dovetail 32 can be readily seen in the lower part of roller block 30 (that is, the part positioned at the base of pocket 22). Bearing holes 34 and contour 31 may also be readily seen. It is understood that roller block 30 may take other shapes within the scope of the present invention.

Figure 7:
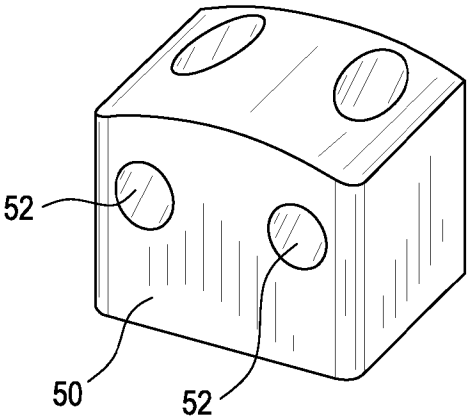
FIG. 7 shows perspective, end and section views of a lock block.
Figure 7:
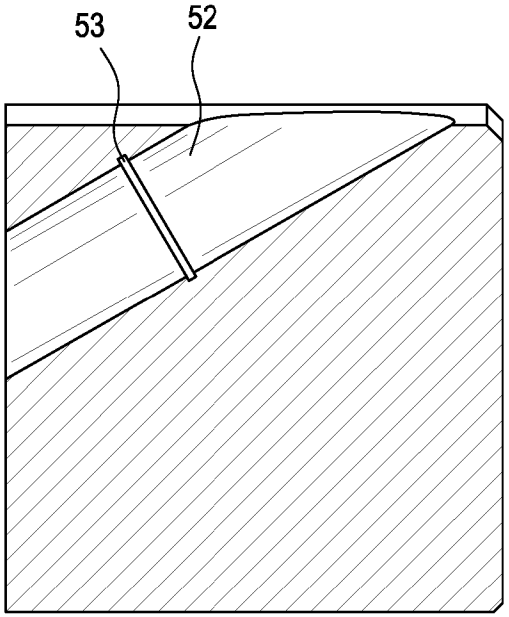
Figure 7:
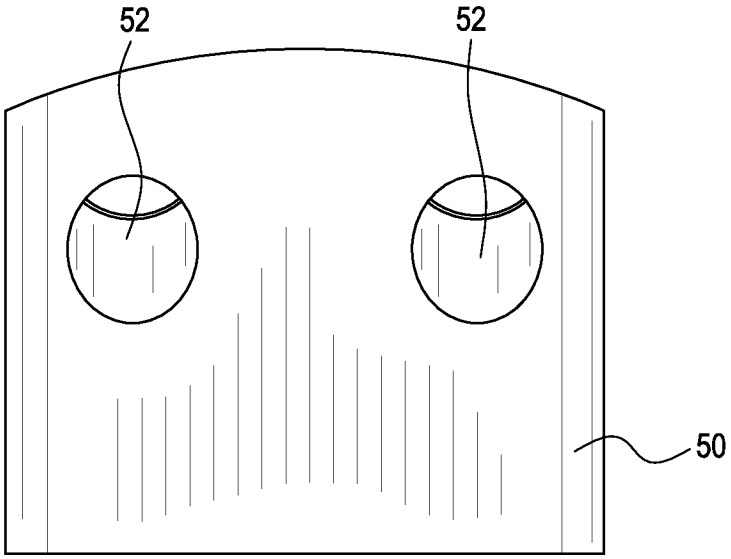

FIG. 7 comprises side, end, and perspective views of one embodiment of the means for preventing longitudinal movement of the roller assembly, namely a lock block 50. In the embodiment shown, lock block 50 is sized and shaped to fit into the space within pocket 22 when the roller blocks 30 and roller 40 are slid or moved longitudinally fully in place. Holes 52 provide a passage for lock block pins (described below). A groove 53 may be provided for an internal snap ring 56, later described.

Figure 8:
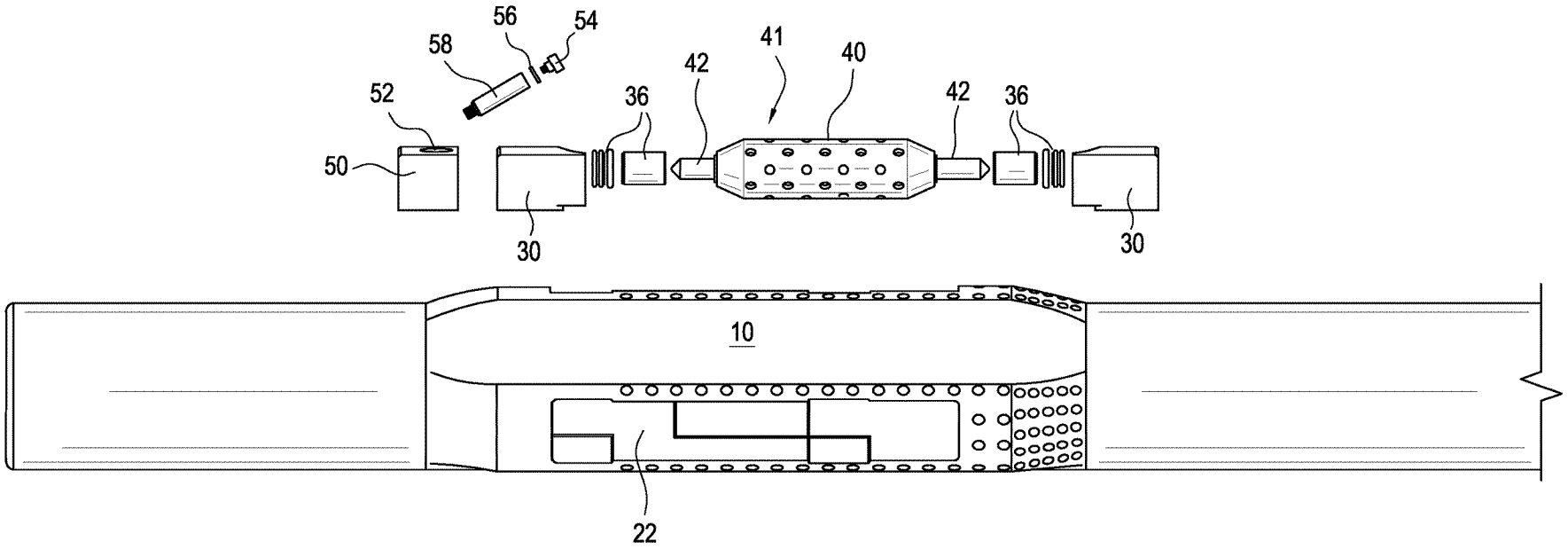
FIG. 8 is an exploded view of the roller reamer, showing the various components positioned outside of the main body.

Referring to FIG. 8: a roller reamer 10 is shown in exploded (unassembled) form, with various of the roller components positioned outside of pocket 22 of main body 20. It is understood that the various components are assembled as described herein.

Figure 10:
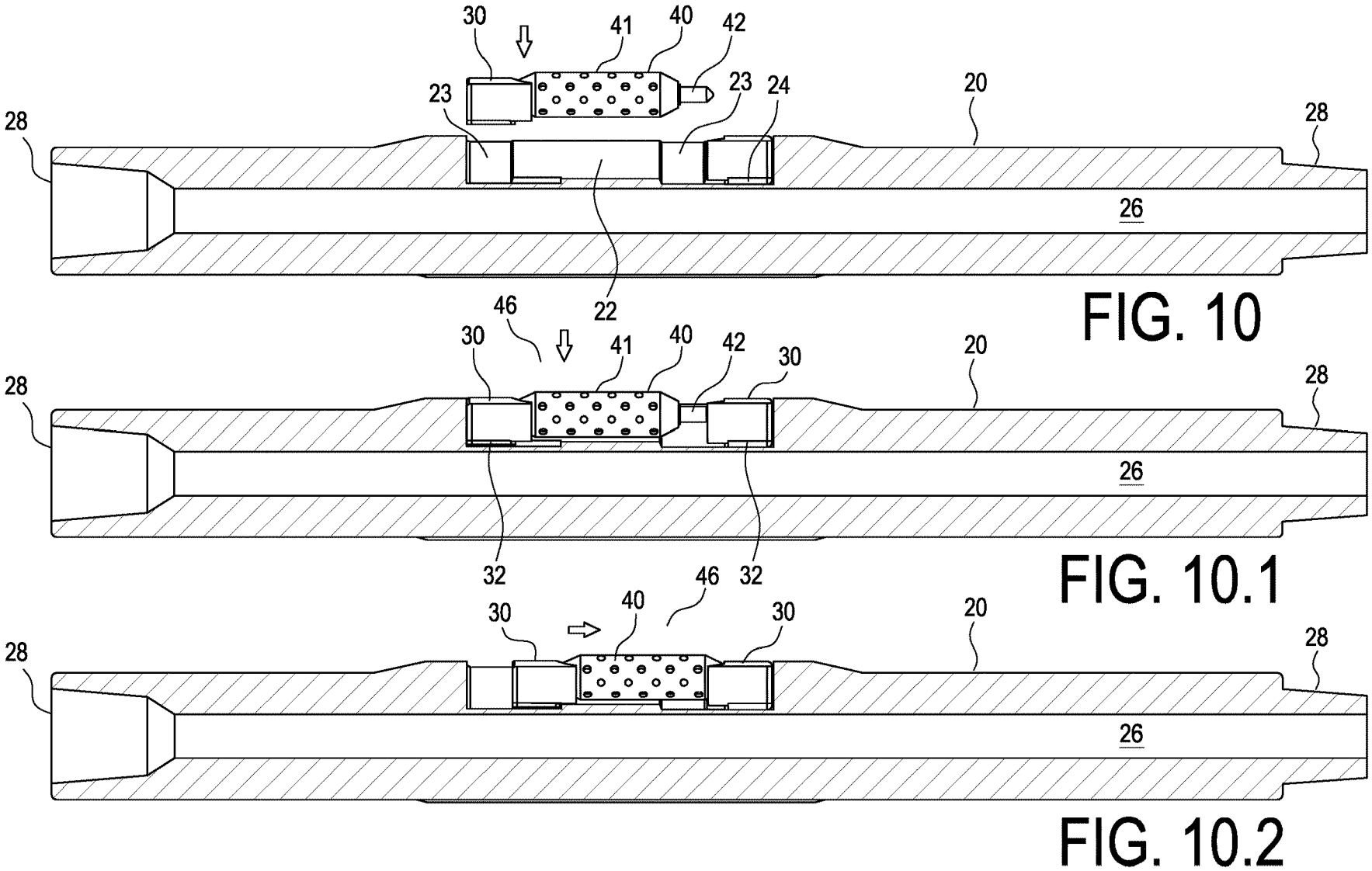
FIGS. 10, 10.1 and 10.2 show a sequence of inserting a roller, with the second, typically upper or uphole, roller block disposed thereon, into place in a pocket of the main body and engaging the dovetail; the lower pin of the roller stabs into the first roller block.

FIGS. 9-10.2 show one sequence of insertion of the rollers and related components into the tool.

FIG. 9 shows a first, typically lower or downhole, roller block 30 positioned to be inserted radially into pocket 22, more particularly into recess 23. The arrow shows the direction of insertion of roller block 30. In FIG. 9.1, roller block 30 has been inserted into recess 23, and dovetails 32 and 24 aligned, in preparation for sliding or moving roller block 30 axially or longitudinally (along the length of main body 20) into place. In FIG. 9.2, roller block 30 has been slid into its final position in dovetail 24, with the dovetails on roller block 30 and roller pocket 22 engaged.

In FIG. 10, a roller 40 with a second or upper roller block 30 positioned thereon (that is, positioned on pin 42, not shown) is in position to be inserted (radially) into pocket 22. The arrow shows the direction of movement. FIG. 10.1 shows roller 40 and roller block 30 thereon inserted into position within pocket 22, with roller block 30 in recess 23, and with dovetail 32 aligned with its corresponding dovetail 24 (in the base of pocket 22), and the lower pin 42 aligned with the bearing hole in the lower roller block 30. In FIG. 10.2, the upper roller block 30 along with roller 40 have been slid or moved axially, see directional arrow, into final position. As previously described, both roller blocks 30 are now radially locked into pockets 22; with roller 40 (via roller pins 42) radially fixed within roller blocks 30, then roller 40 is likewise radially fixed in place.

Figure 11:
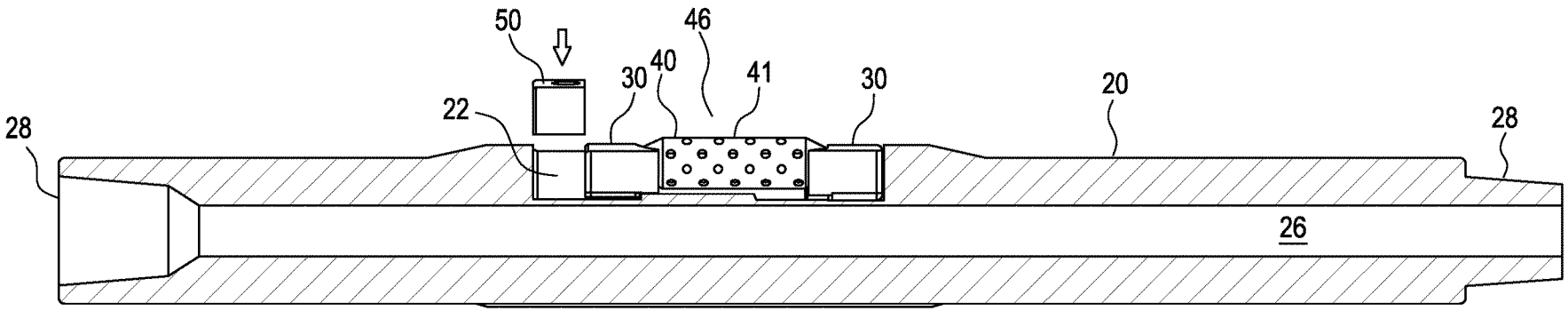
FIGS. 11 and 11.1 show placement of the lock block into the pocket.
Figure 12:
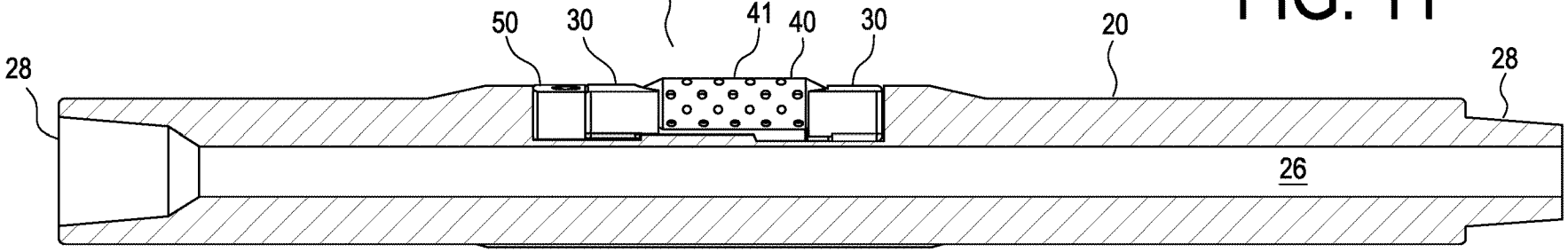
FIG. 12 is a view showing insertion of the locking pins in the lock blocks.
Figure 12:
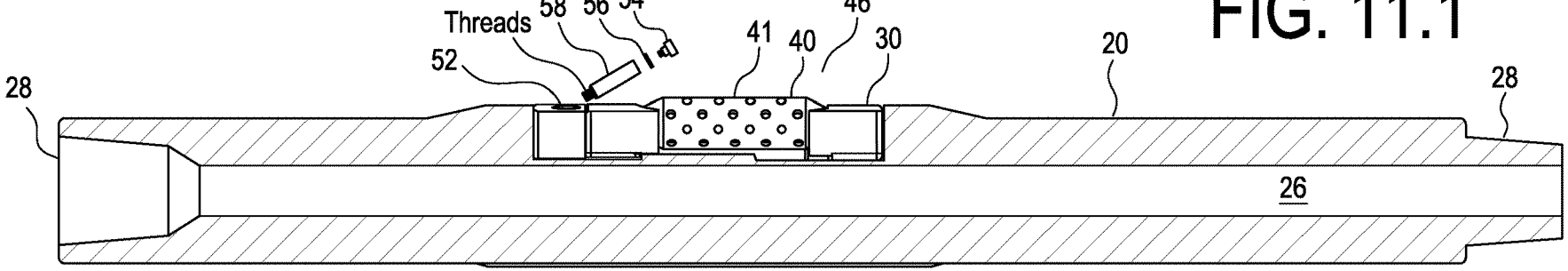

FIG. 11 shows the means for preventing longitudinal movement of the roller assembly, namely lock block 50, positioned to be moved radially into place, in the opening or space at the upper or uphole end of pocket 22; the arrow shows the direction of movement. FIG. 11.1 shows lock block 50 in its final position, substantially filling that space and blocking axial or longitudinal movement of the roller blocks/roller assembly. Referring to FIG. 12, lock block 50 is secured in place by one or more lock block pins 58, having threaded tips, inserted through holes 52 in lock block 50, and screwed (via threaded ends on pins 58) into threaded holes in main body 20. Internal snap rings 56 and shoulder screws 54 lock pins 58 in place.

Alternative Downhole Tool Elements

Figure 13:
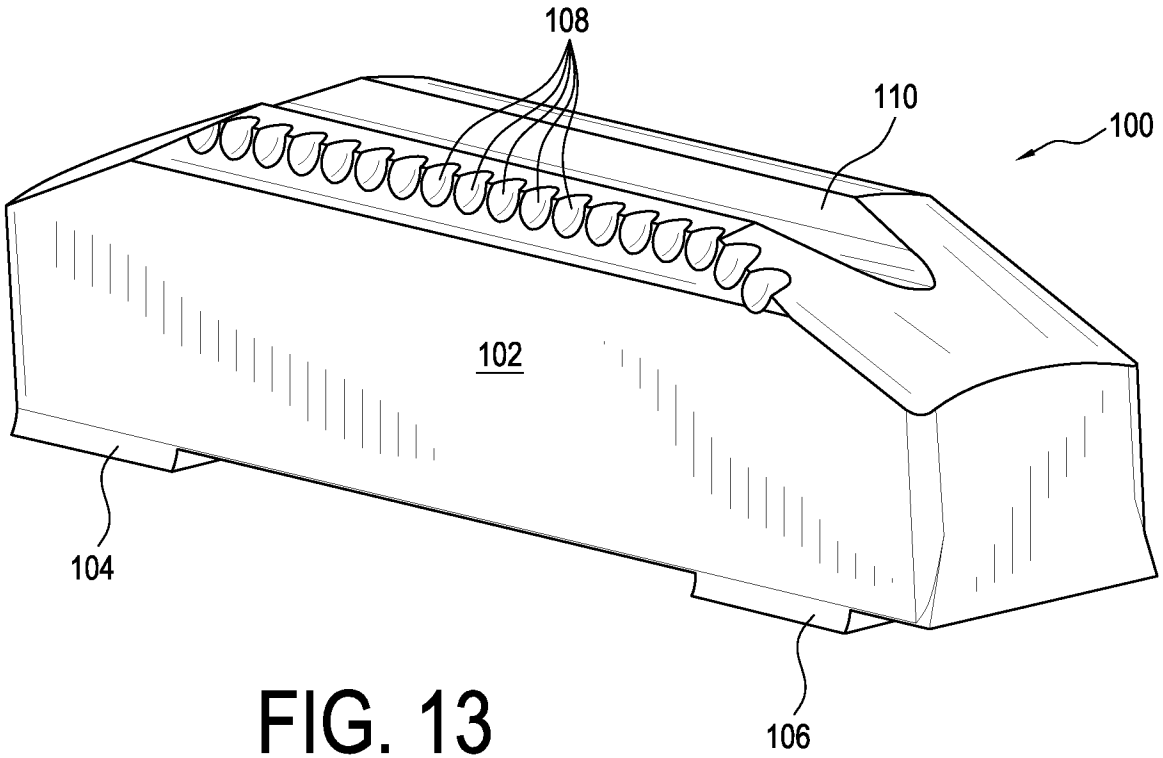
FIG. 13 is a perspective view of a cutter block, for example a PDC (polycrystalline diamond compact) equipped cutter block.
Figure 14:
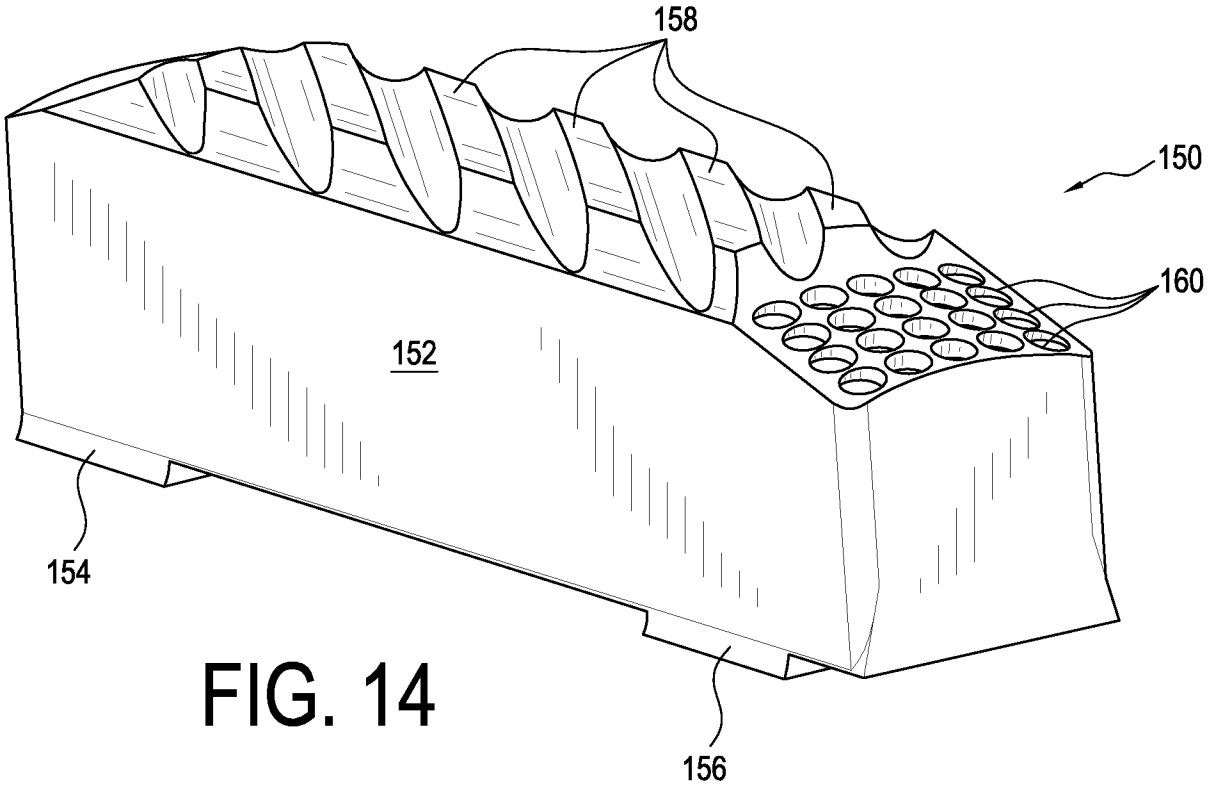
FIG. 14 is a perspective view of a stabilizer block.

In lieu of the above-described roller assemblies, other downhole tool elements can be mounted in the main body pockets, to address particular work requirements. For example, in lieu of downhole tool elements comprising the roller assemblies mounted in the main body pockets, another downhole tool element, for example a sealed bearing cutter, stabilizer blocks, or PDC insert blocks could be mounted. FIG. 13 is a perspective view of a cutter block 100, for example a PDC cutter block. While cutter block 100 may take various forms, by way of example cutter block 100 comprises a main body 102 having locking profiles 104, 106 which engage the locking profile 24 within the pockets 22 in the main body, thereby preventing radial movement of cutter block 100; as described in connection with the roller assembly installations, a lock block 50 would be inserted into pocket 22 in the main body, preventing longitudinal movement of cutter block 100. Cutter block 100 may comprise cutters disposed in cutter recesses 108, which may be PDC cutters, and appropriate contours, such as groove 110, as required. FIG. 14 is a perspective view of a stabilizer block 150, having a main body 152 and locking profiles 154, 156 which engage locking profile 24 within pockets 22 in the main body. Stabilizer profiles or blades 158, along with recesses 160, may be provided. If desired, carbide or similar wear resistant material may be added to the outward surfaces of stabilizer blades 158. Buttons or inserts of carbide or similar wear resistant material may be placed in recesses 160.

CONCLUSION

While the preceding description contains many specificities, it is to be understood that same are presented only to describe some of the presently preferred embodiments of the invention, and not by way of limitation. Changes can be made to various aspects of the invention, without departing from the scope thereof. The tool could be used to reduce torque in drillstring rotation, smooth out wellbores, and eliminate or reduce doglegs and drill cuttings beds. Dimensions may be changed as appropriate.

Therefore, the scope of the invention is to be determined not by the illustrative examples set forth above, but by the appended claims and their legal equivalents.

We claim:

1. A roller reamer, comprising:

an elongated main body having a longitudinal axis therethrough and one or more longitudinal pockets in an outer surface thereof, each of said one or more longitudinal pockets sized and shaped to receive an elongated roller therein, at least one of said one or more longitudinal pockets having a dovetail profile therein;

one or more a roller assemblies, each of said roller assemblies comprising an elongated roller rotatably mounted in roller blocks disposed at each end of said roller, each of said roller blocks comprising a dovetail sized and shaped to engage said dovetail profile within said longitudinal pocket, said roller assembly positioned within one of said longitudinal pockets comprising said dovetail profile so that said roller is positioned within said longitudinal pocket and at least one of said roller blocks is moved longitudinally into said dovetail profile within said longitudinal pocket, whereby said roller blocks and said roller assembly are radially locked within said longitudinal pocket by engagement of said dovetail profile of said longitudinal pocket and said dovetail of said roller blocks; and a lock block positioned within said longitudinal pocket, whereby said lock block prevents longitudinal movement of said roller blocks and said roller assembly within said longitudinal pocket, wherein said lock block is fastened within said pocket by one or more lock block pins through holes in said lock block and extending into and threadably fastened in said main body, said holes in said lock block and said lock block pins oriented at an acute angle to said longitudinal axis of said main body, and further comprising internal snap rings and shoulder screws rotationally locking said lock block pins.

2. The roller reamer of claim 1, wherein said one or more longitudinal pockets comprises three longitudinal pockets spaced about a circumference of said main body.

3. The roller reamer of claim 2, comprising one of said roller assemblies mounted in each of said pockets.

4. The roller reamer of claim 3, further comprising bearings disposed in said roller blocks, and wherein said rollers comprise roller pins extending from both ends, said roller pins extending from both ends disposed in said bearings.

5. The roller reamer of claim 4, wherein said rollers further comprise hardened inserts on an outer surface of said rollers.

* * * * *